United States Patent [19]

Hotine et al.

[11] Patent Number: 4,462,774

[45] Date of Patent: Jul. 31, 1984

[54] ROTARY EXPANDER FLUID PRESSURE DEVICE

[76] Inventors: William Hotine, 633 Ramona Ave., #23; John A. Ziegler, 1180 Bayview Hts. Dr., both of Los Osos, Calif. 93402

[21] Appl. No.: 425,067

[22] Filed: Sep. 27, 1982

[51] Int. Cl.[3] ..... F04C 2/00

[52] U.S. Cl. ..... 418/61 B

[58] Field of Search ..... 418/61 B, 107, 108

[56] References Cited

U.S. PATENT DOCUMENTS

| | | | |
|---|---|---|---|
| 658,556 | 9/1900 | Pitt | 418/61 B |
| 2,796,029 | 6/1957 | Bourke | 418/108 |
| 3,441,007 | 4/1969 | Kwaak | 418/61 B |
| 3,450,107 | 6/1969 | Radziwill et al. | 418/61 B |
| 3,819,307 | 6/1974 | Uppal | 418/61 B |

FOREIGN PATENT DOCUMENTS

| | | | |
|---|---|---|---|
| 1924380 | 11/1970 | Fed. Rep. of Germany | 418/61 B |

*Primary Examiner*—William R. Cline
*Assistant Examiner*—John J. McGlew, Jr.

[57] ABSTRACT

The rotary expander device combines a square working chamber with a three lobed sext-arcuate rotary working member which defines four expansible and contractible spandrel chambers in the corners of the square as the three lobed rotor revolves and its external surfaces make wiping contact with the interior surfaces of the square working chamber. Fluid flow from exterior intake and exhaust ports to four ports in the spandrel corners is controlled by a rotary valve coupled to the drive shaft, which is coupled to the center of the rotor. The ports and valving provide sequential spandrel chamber expansion and contraction with intake and exhaust of fluid as the sext-arcuate rotor revolves with its center describing a retrograde circular orbit around the center of the square chamber. The device may serve as either a motor when fluid driven or a pump when shaft driven.

7 Claims, 13 Drawing Figures

ROTARY EXPANDER FLUID PRESSURE DEVICE

BACKGROUND OF THE INVENTION

Previous rotary expander devices of the gerotor type or the Wankel trochoidal rotor type have required working members and working chambers having shapes which are expensive and difficult to fabricate. There is, therefore, a need for a fluid pressure device having simple shapes of working member and working chamber which are easily and economically fabricated.

Worn members on previous devices have caused increased clearances and excessive leakage causing deterioration of efficiency and have required replacement with new parts. There is therefore a need for a fluid pressure device which is designed in a manner which enables adjustment of the clearances between working member and working chamber thus enabling easy fitting at assembly and take up of wear at repair.

The present invention is a rotary expander device which employs a diagonally split square flat sided working chamber which can be adjusted by shim means to fit a sext-arcuate working member with flat sides and arcuate periphery. The six arcuate surfaces of the rotor periphery are true arcs with radii centered on vertices of an equilateral triangle. The flat sides of the chamber form a true square in which the three lobed rotor revolves, with the chamber width adjustable by shim means to fit the width of the rotor.

In the present invention, as the three lobed rotor revolves in the square chamber it makes sliding contact with all four sides simultaneously and the geometry of these parts causes the center of the rotor to describe a circular obit around the center of the square chamber. The orbit is retrograde to the direction of rotation of the rotor and deviates slightly from a true circle. The orbital velocity is three times the rotor velocity and is usefully employed as a novel feature of the invention. Orbiting of the rotors of the previous art required auxiliary mechanisms, while the orbiting of the rotor of the present invention is automatically provided by the geometry.

SUMMARY OF THE INVENTION the present invention is a rotary expander device having a square working chamber which is split diagonally across the square with the two halves separated by laminated shims and bolted together to make a chamber member. The width of the chamber is defined on one side by a flat plate member spaced by a laminated shim and on the other side by the flat side of a mating valve plate member. The valve plate member has a hollow cylindrical valve fitting a central bore which controls flow through ducts from two external fluid ports to four internal ports in the side of the working chamber at the four corners of the square chamber. The opposite side of the valve plate member mates with a drive plate member which supports the bearings of a drive shaft which extends through the center of the hollow cylindrical valve. The valve is rotated by a coupling to the drive shaft. The end of the drive shaft which extends through the center of the valve is coupled to the rotor.

In one aspect of the invention, the coupling between the rotor and the drive shaft is a universal joint of the Hooke type which compensate for the parallel misalignment of the orbiting rotor so that the drive shaft rotates at the same rotational velocity as the rotor and in the same direction.

In another aspect of the invention, the coupling between the rotor and the drive shaft is a crank type, in which the end of the drive shaft is provided with a crank pin which fits a compliant bearing at the center of the rotor, so that the drive shaft rotates at three times the rotational velocity of the rotor and in the opposite direction. As the valve must rotate at the same velocity as the rotor and in the same direction it is coupled through reduction gears to the drive shaft.

The four members of the device are held together by through bolts to form the complete assembly.

Adjustment for fit of rotor is easily accomplished by removal of the flat end plate by removing through bolts, removal of square chamber clamp bolts, peeling of laminated shims between halves of chamber, and peeling of shim under end plate.

When used as a motor, the rotor delivers 50% overlapping moments of torque every 30° or 12 times per revolution, and is thus capable of smoothly delivering very low rotational speeds. When used as a pump the flow of fluid will have a minimum of pulsation. As the rotor is constrained by the sqare chamber and is symmetrical and balanced, the device has minimum rotational vibration. Reversal of motor fluid flow reverses shaft rotation, while reversal of pump shaft rotation reverses fluid flow. Both the rotor and valve can be fabricated from a compliant or compressible material having a low coefficient of friction to minimize leakage and get a tight fit for certain applications.

Accordingly, it is an object of the present invention to provide a rotary expander device having shapes of working member and working chamber which are easily and economically fabricated.

Another object of the invention is to provide a rotary expander device capable of easy adjustment of fit between rotor and chamber to facilitate assembly or repair.

Still another object of the invention is to provide a device capable of either of two operational speeds.

For a better understanding of the invention, its advantages, and objects attained by its use, reference should be had to the accompanying drawings and to the accompanying description, in which there is illustrated and described two preferred embodiments of the invention.

DESCRIPTION OF FIRST PREFERRED EMBODIMENT

Figure 6:
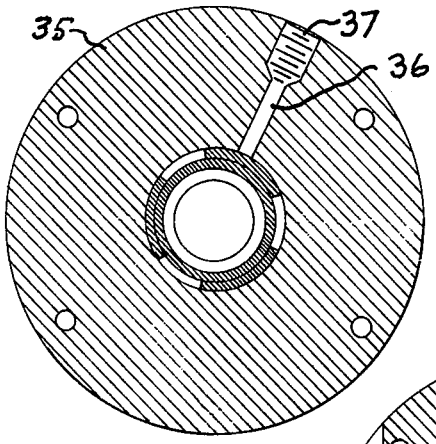
FIG. 6 is a view through lines 6—6 of FIG. 2.
Figure 7:
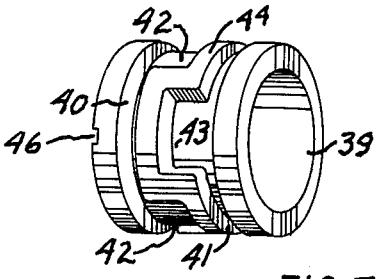
FIG. 7 is a perspective view of the hollow cylindrical rotary valve.
Figure 1:
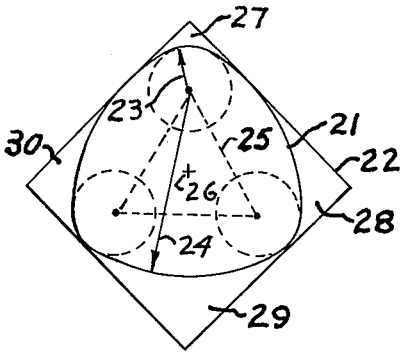
FIG. 1 is a geometrical diagram of the rotor and chamber of the invention.

With reference to FIG. 1, which is a geometric diagram showing the outline of the three lobed working member and the square working chamber, arcuate working member 21 lies within square working chamber 22, and a side of square chamber 22 is made equal to the sum of small radius 23 and large radius 24, which are centered on one vertex corner of the equilateral triangle 25. The center 26 of the equilateral triangle 25 is the center of the trochoidal working member 21. The periphery of member 21 describes six true circular arcs with radii centered on each vertex of triangle 25. Each arc merges tangentially with the next arc around the periphery as can be seen from reference to FIG. 1. It can also be seen in FIG. 1 that the member 21 is in contact with all four sides of chamber 22, thus defining four spandrel chambers in the corners of the square between rotor and chamber. In the diagram of FIG. 1, the rotor is shown in a position which illustrates the expansible and contractible spandrel chambers of the invention. Chamber 27 is smallest, chamber 28 shows an intermediate size, and chamber 29 shows the largest chamber. If member 21 rotates clockwise, chamber 27 will expand in volume, chamber 28 will also expand in volume, while chamber 29 and chamber 30 will contract in volume. When the member 21 has rotated 60°, chamber 30 is then the smallest size, like chamber 27 in the diagram, and chamber 28 will be the largest. There will be a similar change in spandrel chamber volume every 60° during one rotation of member 21. The rotational change in chamber volume takes place in a counterclockwise manner around the corners of the square chamber 22. Intake of fluid under pressure may thus be provided for chambers 27 and 28 starting at the position of member 21 shown in FIG. 1, and ending at the 60° rotational position of member 21. During this 60° of rotation, exhaust of fluid may be provided for chambers 29 and 30. The fluid pressure will thus expand chambers 27 and 28 and impart a clockwise torque moment to member 21 during the 60° rotation, and exhaust of fluid from chambers 29 and 30 minimizes any counter-torque. It can be thus understood that there will be a torque moment imparted to the member 21 every 30° of its rotation, by arranging the valving to admit fluid pressure to a first working chamber corner and exhaust fluid at an opposite second working chamber corner, over a period of 60° of working member rotation; and then exhaust fluid from the first working chamber corner and admit fluid pressure from the opposite second working chamber corner. The valving may be arranged in this manner by having a rotary valve which has alternate 60° segments around its circumference for intake and exhaust, as illustrated in FIG. 7, and shown schematically in the linear projection of the valve circumference shown in FIG. 8. Also, the valve is shown in section in FIGS. 2 and 9.

The arcs of the surface of the periphery of member 21 may be easily and accurately generated during fabrication by the use of centers located at the three vertices of the equilateral triangle 25. All other surfaces of member 21 are flat. The center 26 of member 21 will be off the center of the square chamber 22, and as member 21 rotates clockwise in chamber 22, the center 26 of member 21 will describe a circular orbit around the center of chamber 22. This orbit will deviate slightly from a true circle due to the geometry. This circular orbit may be employed usefully, as described later in the second preferred embodiment.

Figure 2:
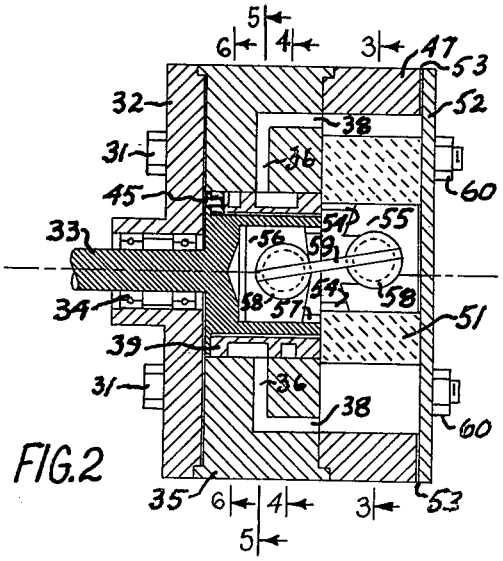
FIG. 2 is a sectional view along the axis of a first embodiment of the invention.
Figure 12:
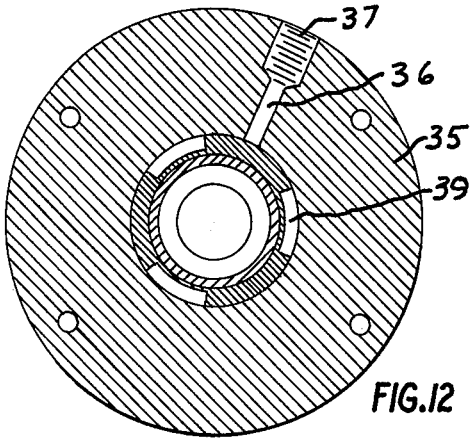
FIG. 12 is a view through lines 12—12 of FIG. 9.
Figure 13:
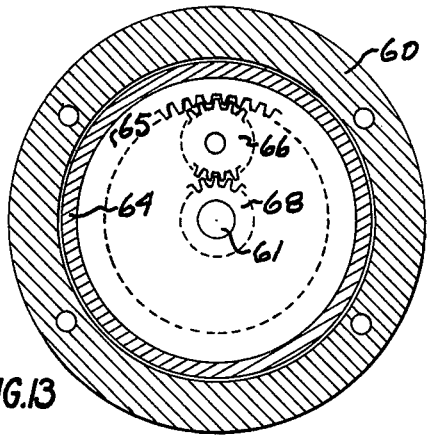
FIG. 13 is a view through lines 13—13 of FIG. 9, showing gears schematically.
Figure 10:
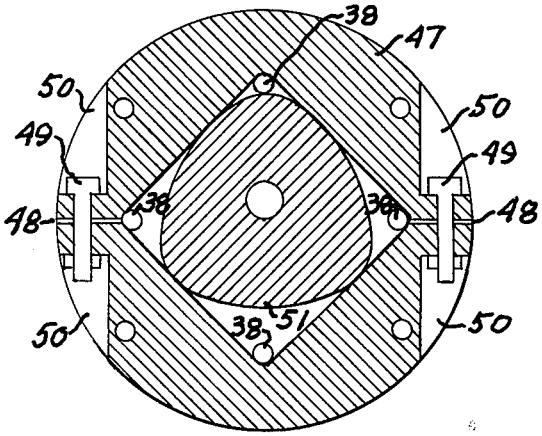
FIG. 10 is a view through lines 10—10 of FIG. 9.
Figure 11:
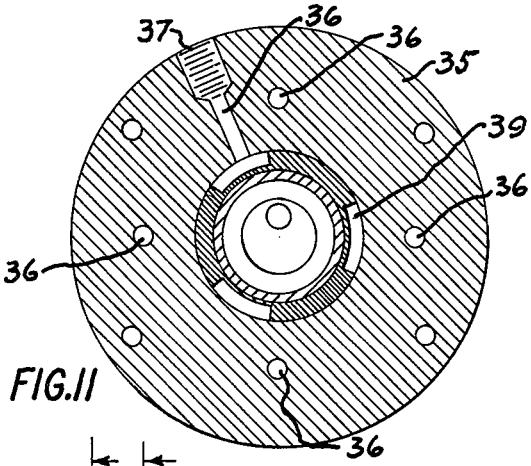
FIG. 11 is a view through lines 11—11 of FIG. 9.
Figure 8:
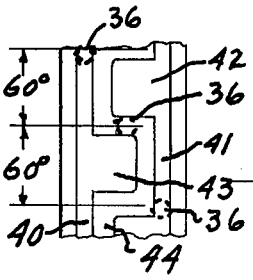
FIG. 8 is a linear projection of part of the circumference of the valve of FIG. 7.

With reference to FIGS. 2,3,4,5,6,7, and 8, which illustrate the construction of the first preferred embodiment, in FIG. 2 there is shown a sectional view along the axis of the novel fluid pressure device of the invention. The body assembly of FIG. 2 is composed of four members which are bolted together by through bolts 31. At the left of FIG. 2, drive plate member 32 supports rotatable drive shaft 33 in bearings 34. Drive shaft 33 is hollow at its interior end and has a large diameter bore. Valve plate member 35 has fluid ducts 36 ending in external ports 37 and internal ports 38. The hollow cylindrical rotary valve 39 has a sliding fit in the interior axial bore of member 35, and has two fluid channel grooves 40 and 41 around its circumference. Referring to FIGS. 7 and 8, grooves 40 and 41 have rectangular laterally widened portions 42 and 43 which alternate every 60° around the circumference of valve 39. There is thus a zig-zag wall 44 which separates the intake and exhaust grooves 40 and 41. The interior ends of ducts 36 leading to external ports 37 enter the central bore of member 35 at the axial locations of grooves 40 and 41, while the interior ends of ducts 36 leading to internal ports 38 enter this bore at the center of valve member 39 as shown by a dotted circle at the center of the diagram of FIG. 8. As valve 39 rotates, the ducts 36 from ports 38 are alternately connected every 60° via spaces 42 and 43 and grooves 40 and 41 to the two ducts 36 leading to external ports 37. The valve 39 cuts off briefly at each alternation at the point shown by the dotted circle representing a duct 36, in FIG. 8. As this takes place at a point of minimum change in spandrel chamber volume it has no adverse effect. The valve 39 is rotated by a pin 45 extending from a flange on the drive shaft 33 into a radial slot 46 on the end of the hollow cylinder. The interior bore of valve 39 clears the exterior of drive shaft 33, allowing the valve to be aligned axially by the bore of member 35. The valve 39 is hydrostatically balanced by its design, requiring little power to drive it.

Figure 3:
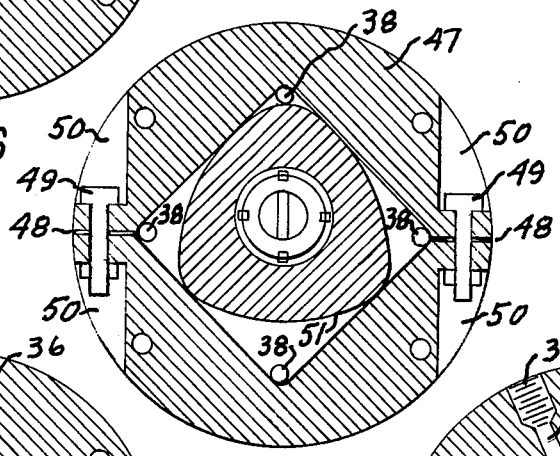
FIG. 3 is a view through lines 3—3 of FIG. 2.
Figure 5:
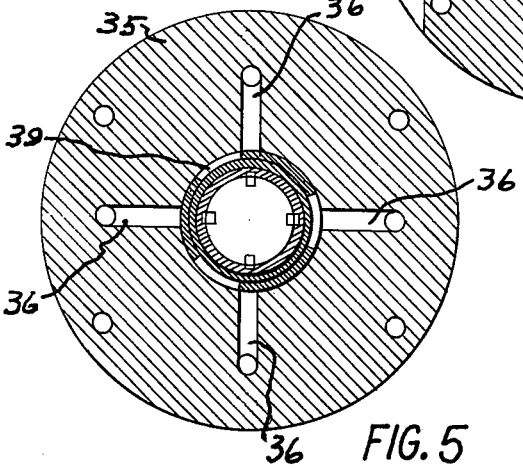
FIG. 5 is a view through lines 5—5 of FIG. 2.
Figure 4:
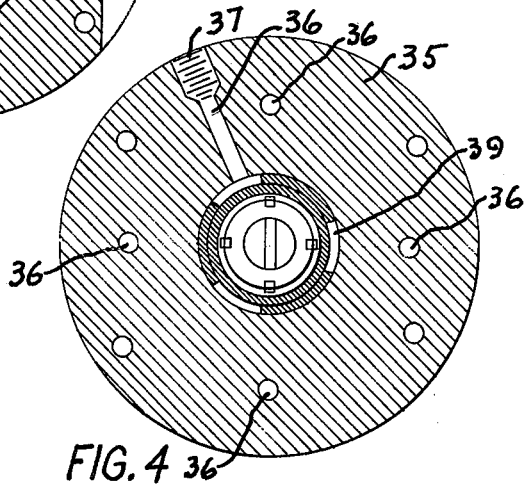
FIG. 4 is a view through lines 4—4 of FIG. 2.

The working chamber member 47 is shown in FIG. 3, and is split into two parts along the diagonal to the square. The two parts are spaced by laminated shims 48 and bolted together by bolts 49 which fit in recesses 50 at the exterior of member 47. Adjustment of shim thickness can therefore adjust the dimension of the square working chamber of member 47, thus allowing looser tolerances of parts and enabling take up of excessive clearance between working member 51 periphery and sides of chamber 47. The side of member 35 mating with chamber 47 is flat. End plate member 52 is flat and is spaced from chamber plate member 47 by laminated shim 53. Adjustment of shim thickness can therefore adjust the width of the working chamber defined by the flat wall of member 35 and the flat wall of member 52, thus allowing looser tolerances of parts and enabling take up of excessive clearance between working member 51 and the walls of the working chamber.

The working member 51 has a centrally located axial bore which has two keyways 54 diametrically opposite each other which mate with end 55 of a universal coupling of the Hooke type. The other end 56 of the coupling mates with two keyways 57 diametrically opposite each other which are in the bore of the hollow end of drive shaft 33. Two spheres 58 have grooves cut into their surface 90° apart, with the width of the grooves fitting the thickness of the intermediate member 59 and the end members 55 and 56 of the coupling. This type of coupling is well known and has great practicality, allowing a large amount of axial misalignment between the working member 51 and the drive member 33. Other couplings may be used, such as the dog bone spline type. The nuts 60 on through bolts 31 hold the device assembly together.

DESCRIPTION OF THE SECOND PREFERRED EMBODIMENT

Figure 9:
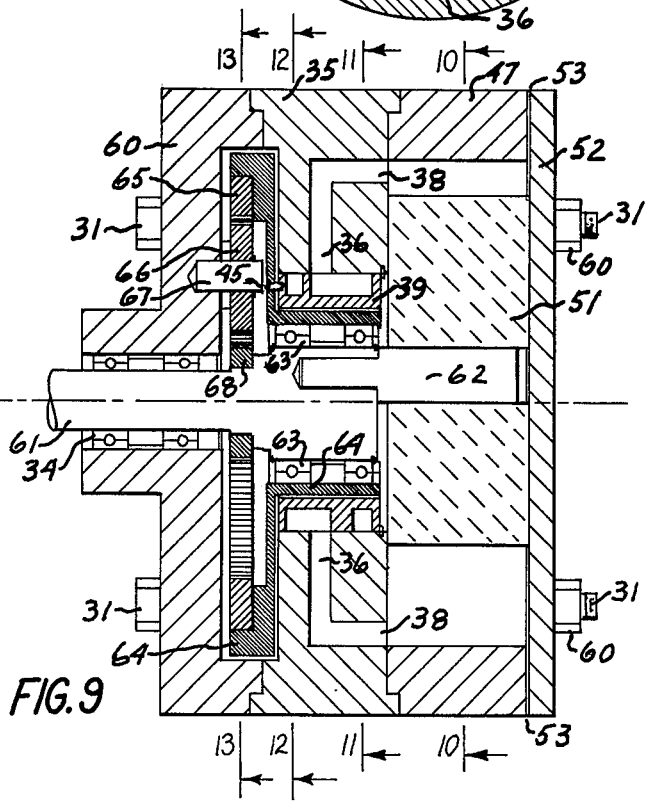
FIG. 9 is a sectional view along the axis of a second embodiment of the invention.

With reference to FIGS. 9,10,11,12, and 13, which illustrate the construction of the second embodiment, in FIG. 9 there is shown a sectional view along the axis of the device. The body assembly of FIG. 9 is composed of four members which are bolted together by through bolts 31. At the left of FIG. 9, drive plate 60 supports drive shaft 61 in bearings 34. Drive shaft 61 has a crank pin 62 at its interior end and bearings 63 mounted on its interior periphery. Bearings 63 rotatably support internal ring gear member 64 which has an internal spur gear 65 driven by an idler gear 66 which is supported on shaft 67 projecting from member 60 on its interior. Spur gear 68 on shaft 61 drives idler gear 66. The gear ratio from gear 68 to gear 65 is one to three. The crank pin 62 fits a bore at the center of working member 51, so that as the center of working member 51 describes a circular orbit around the center of the working chamber, it delivers a torque moment to the drive member 61 by means of the crank type coupling. As the orbital velocity is three times the velocity of the rotation of the working member 51, the rotational velocity of the drive shaft 61 will be the same, and is reduced by the one to three gear ratio so that internal gear member 64 rotates at the same velocity as working member 51, and drives valve rotor 39 by a pin and slot coupling allowing axial misalignment of valve rotor 39 and internal gear member 64. The interior bore of valve 39 clears the exterior of member 64, while the exterior of valve 39 fits the bore of valve plate member 35. The rotary valve 39 of the second embodiment illustrated in FIG. 7 operates in the same manner as has been described before together with ports and ducts in member 35 to accomplish the control of fluid flow in a similar manner. Member 47 mates with member 35 and has been previously described. Member 52 is held to member 47 by through bolts 31 and nuts 60 and has been previously described.

While the two preferred embodiments of the invention have been described, the form of the invention described should be considered as illustrative and not as limiting the scope of the following claims.

We claim:

1. An improved fluid pressure device, said improvement comprising:

a rotatable working member with flat sides and with a periphery having six arcuate adjoining surfaces, the plane of each said arcuate surface describing a true circular arc having a radius centered on a vertex of an equilateral triangle;

a working chamber with flat sides and with a rigid square perimeter, each side of said square perimeter being dimensionally equal to the sum of the two radii of opposite arcs of said working member periphery;

a body provided with ducts for flow of working fluid to and from ports in corners of said working chamber;

drive means rotatably supported in said body;

coupling means for transmitting torque between said working member and said drive means; and valve means in said body, said valve means coupled to said drive means and cooperable with said ducts to control fluid flow whereby fluid flow in said ducts is coincident with rotation of said drive means.

2. The device of claim 1 wherein said coupling means compensates for parallel misalignment between said working member and said drive means.

3. The device of claim 1 wherein the interior dimensions of said working chamber are adjustable to fit said working member by shims placed between parts of said body.

4. The device of claim 1 wherein said valve means is directly synchronized with the rotation of said drive means.

5. The device of claim 1 wherein said valve means is synchronized by reduction gear means with the rotation of said drive means.

6. In a fluid pressure device including a body, a first member of said body defining the square perimeter of a working chamber, a second member of said body defining a first side of said working chamber, said second member provided with means for ducting and porting fluid to and from corners of said working chamber in cooperation with rotary valve means supported centrally in said body, rotatable drive means supported coaxially to said valve means in said body, with a third member of said body defining the second side of said working chamber, the improvement comprising a rotatable working member having a perimeter of six arcuate adjoining surfaces with each vertex of an equilateral triangle the center for the radii of opposite arcs of said perimeter of said working member.

7. In a fluid pressure device including a body, a first member of said body defining the square perimeter of a working chamber, a second member of said body defining a first side of said working chamber, said second member provided with means for ducting and porting fluid to and from corners of said working chamber in cooperation with rotary valve means supported centrally in said body, rotatable drive means supported coaxially to said valve means in said body, with a third member of said body defining the second side of said working chamber, the improvement comprising a rotatable working member having a perimeter of six arcuate adjoining surfaces with each vertex of an equilateral triangle the center for the radii of opposite arcs of said perimeter of said working member, with three of said arcs having equal radii designated "R" and the opposite arcs to said three arcs having equal radii designated "C", and with the dimension of a side of said square perimeter of said square working chamber equal to the dimension of "R"+"C".

* * * * *